US005679916A

United States Patent [19]

Weichert

[11] Patent Number: 5,679,916

[45] Date of Patent: Oct. 21, 1997

[54] GUN SILENCER

[75] Inventor: Berthold Weichert, Zimmern, Germany

[73] Assignee: Heckler & Koch GmbH, Oberndorf/Neckar, Germany

[21] Appl. No.: 406,049

[22] Filed: Mar. 17, 1995

[51] Int. Cl.[6] ..... F41A 21/30

[52] U.S. Cl. ..... 89/14.4; 191/223; 191/232

[58] Field of Search ..... 89/14.4, 14.2; 181/223, 232

[56] References Cited

U.S. PATENT DOCUMENTS

| | | | |
|---|---|---|---|
| 4,920,854 | 5/1990 | Scanlon | 89/14.4 |
| 4,939,977 | 7/1990 | Straup | 89/14.4 |

FOREIGN PATENT DOCUMENTS

| | | | |
|---|---|---|---|
| 39274 | 6/1909 | Austria . | |
| 480849 | 3/1948 | Belgium . | |
| 323574 | 9/1903 | France . | |
| 684938 | 7/1930 | France | 89/14.4 |
| 2038987 | 1/1971 | France . | |
| 2141782 | 1/1973 | France . | |
| 1553874 | 10/1971 | Germany . | |
| 1703420 | 4/1976 | Germany . | |
| 8701928 | 7/1988 | Germany . | |
| 30240 | of 1911 | United Kingdom . | |

OTHER PUBLICATIONS

English translation of Austrian Patent #39,274.
English translation of French Patent #684,938.

*Primary Examiner*—Stephen M. Johnson
*Attorney, Agent, or Firm*—Cowan, Liebowitz & Latman, P.C.; R. Lewis Gable

[57] ABSTRACT

A silencer for a firearm is disclosed as comprising a composite outer wall, an end piece which forms a silencer muzzle and in which is located an exit opening, an attachment piece which is attached to said end piece, and a middle piece which is positioned between the attachment piece and the end piece. The middle piece comprises a selected number of successive chambers which are aligned with each other. Each of chambers has a firing opening and an outside wall. Each of the chambers is attached in a modular fashion directly to an adjoining one of the selected number of chambers. The outside walls of the selected number of chambers form the composite silencer wall. The number of chambers is selected in accordance with the intended use of said silencer.

11 Claims, 1 Drawing Sheet

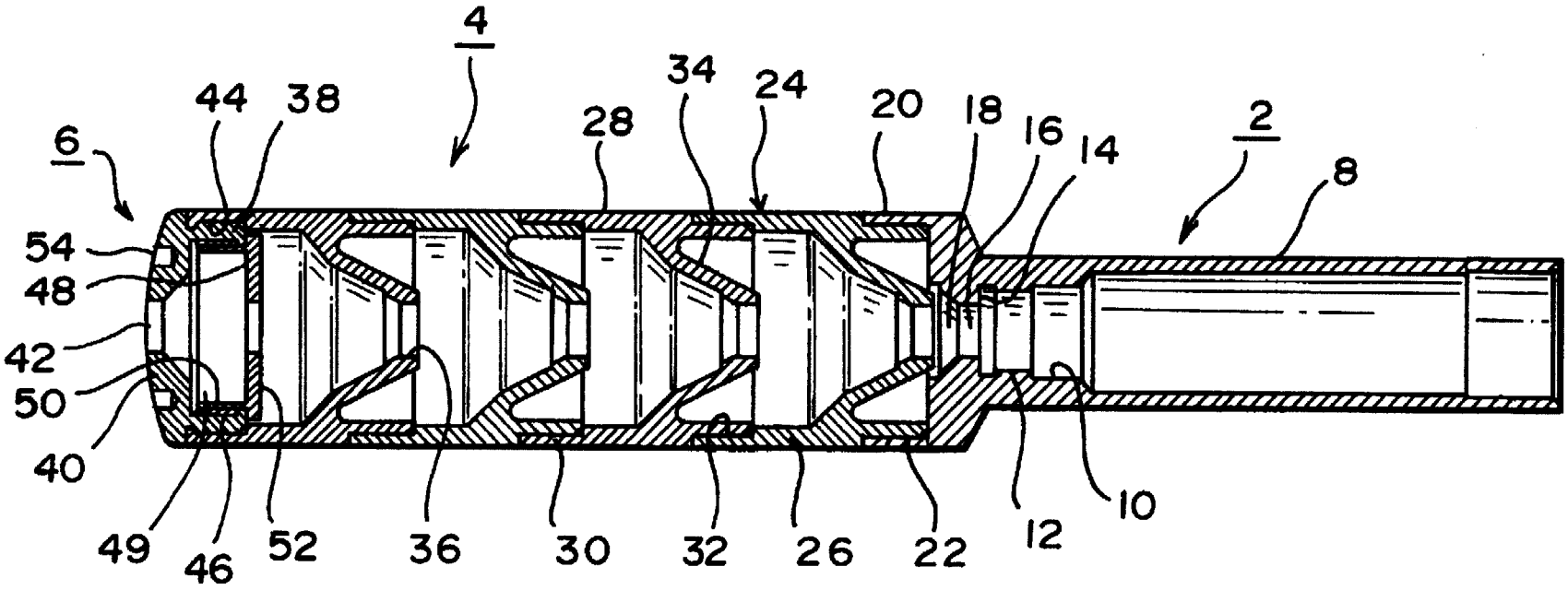
2
8
10
12
14
16
18
20
22
24
26
28
30
32
34
36
38
40
42
44
46
48
49
50
52
54
4
6

GUN SILENCER

FIELD OF THE INVENTION

This invention relates to a silencer as defined in the preamble of claim 1, as it is known from FR-A-684 938 (VERGNE).

This known silencer consists of an attachment piece that can be attached to the muzzle of a weapon, of an end piece, and, in between, of a series of rings that are successively placed in a centered manner, and that form the outer wall of the silencer, and between each of which a dividing wall featuring a firing opening is set, thus forming successive chambers.

The individual rings differ from each other in terms of their length so that only one single, specific ring is associated with each longitudinal segment of the silencer.

It is known from FR-8-323 574 (HUMBERT) that the structural members that constitute the individual chambers can be arranged within a common outer barrel.

BACKGROUND OF THE INVENTION

The terms used below, such as front and back, or front and rear, relate to the firing direction, with the front pointing in the firing direction, the back pointing away from the firing direction.

A silencer contemporary, customary is known from DE 17 03 420 B1 or the corresponding U.S. Pat. No. 3,385,164 (WALTHER). Its middle piece has a cylindrical jacket tube to whose back the attachment piece is attached, with the end piece being attached to its front. The attachment piece can be screwed in a gas-tight manner onto an outside thread attached to the muzzle of a rifle. In addition to other elements, the jacket tube contains several successive chamber parts supported by each other, each of which is provided with a longitudinal jacket resting against the inside wall of the jacket tube, and a crossbar. The crossbar extends by and large transversely to the longitudinal jacket, and thus transversely to the longitudinal axis of the silencer. In its middle, it has a firing opening, from where it tapers outward towards the front. The chamber parts are centered by means of the jacket tube.

Similar silencers are known from the following: DE-PS 241 846 (BILLERBECK), DE-OS 15 53 874 (H&K) and 28 24 546 (FEHSE), GB Patent 30 240/1909 (SMALL ARMS COMPANY) and U.S. Pat. Nos. 1,017,033 (KENNEY) and 1,111,202 (WESTFALL).

The number and possibly also the shape of the chamber parts must principally be adapted to the weapon and to the ammunition used in it. Another aspect to consider in this context are the requirements for the silencer. It can be assumed that each chamber part reduces the muzzle report by about 4 db—to the extent that only a limited number of chamber parts are used.

Overall, a silencer should always be as short as possible. This is because it increases the total length of the firearm that has been painstakingly shortened by other design means, and it furthermore adds weight to the muzzle, thus impairing the weapon's balance.

Although different weapons may have the same caliber and muzzle shapes, it is still necessary to manufacture and stock many silencers with different lengths, in order to meet all requirements. This heavy expenditure is a disadvantage.

The invention's task is to improve the initially mentioned, known silencer in such a way that it can be adapted to the particular requirements with minor effort.

The invention solves this problem by means of the object of claim 1, which means an object in which the features of this class are combined with the other features, i.e., each chamber part is attached according to a modular principle directly to the adjoining chamber part, and the outer walls of the successive chamber parts form the outer wall of the silencer.

The successive outer walls of the chamber parts thus form the silencer's outer wall. The jacket tube necessary for the known silencer is thus eliminated.

In known silencers, the jacket tube directly limits the expansion chamber. It must therefore have a strength and wall thickness that is able to withstand the developing gas pressure. The longitudinal jackets of the known chamber parts essentially function as spacing bushings. In that way, they increase the silencer's weight considerably, something that is a disadvantage for the reasons mentioned earlier. Because of the elimination of the jacket tube, the object according to the invention has none of these disadvantages. The silencer according to the invention differs from known silencers not only because of its reduced weight, but also because of its lower manufacturing costs.

In addition, the jacket tube no longer determines the silencer's structural length, because it is eliminated here. Instead, this silencer can in each case be assembled optionally, as desired, from a number of suitable chamber parts in such a way that it is optimized in respect to a particular application area, such as the length of the barrel, the type of cartridge, and the desired silencing effect. To achieve this, it is only necessary that a sufficient number of chamber parts of the particular design must be manufactured, which is possible in a simple and reasonably-priced fashion, for example, by die-casting, but in particular on automatic lathes. During assembly, a large number of different silencers then can be assembled by suitably combining the chamber parts using a modular principle.

A muzzle attachment to be placed on barrels for untitled projectiles is known from DE-OS 1 553 895 or the corresponding FR Patent 1 597 401 (OY TAMPELLA). Such muzzle attachments are used to achieve a considerable ballistic improvement in the flight path of the unrifled projectiles, for example, projectiles fired from a mortar. But they are not silencers.

Such muzzle attachments usually do not have a jacket tube. The known muzzle attachment consists of a stack of roughly plate-edge-shaped ring disks. Spacers are positioned between the individual ring disks. The stack is held together overall by many tie rods. The muzzle gases can escape to the outside along the entire length of the muzzle attachment, directly between the ring disks.

A similar arrangement is also known from AT-39 274 (LOTH), relating to a silencer. This silencer also has chambers held together in a similar manner by tie rods, as is the case in the above-mentioned silencers, each of which employs a jacket tube.

SUMMARY OF THE INVENTION

In the silencer according to the invention, the individual chamber parts can be connected to each other, to the attachment piece, and/or to the end piece, for instance, by resistance welding. Parts with a non-circular cross-section also can be connected to each other in this way.

According to a preferred version of the invention, however, each chamber part is provided with a circumferential threading at its front end and with a circumferential threading that complements the former at its rear end, whereby, for instance and preferably so, it has a female thread at its front end, and a male thread at its rear end. The end piece and the attachment piece each are also equipped with a male or female thread matching these threads. The direct attachment of the chamber parts—to each other as well as to end piece and attachment piece—by means of threads enables a particularly simple assembly of the silencer; in addition to a gas-tight connection. The combination of male and female threads offers the advantage of preventing any incorrect assembly, i.e., installation of a chamber part in the wrong direction. This is particularly important in the case of chamber parts whose silencing effect depends on the direction in which the muzzle gases flow through them.

It is principally possible, and in the case of an arrangement of a larger number of chamber parts also advantageous, to associate a cylindrical centering segment with each thread in the known fashion. This ensures an exactly centered, mutual association of the silencer elements according to the invention.

In the case of a smaller number of chamber parts, for instance, five chamber parts, the centering effect of a fine screw thread is however already completely adequate; this is true especially when the chamber parts, plus their circumferential threads, were manufactured with the narrow tolerances that can be easily achieved with an automatic lathe.

The thread connections of the individual elements permit an easy disassembly of the silencer, for instance, for cleaning. But this also entails hazards: improper or insufficient screwing of the fine screw threads may result in damage, as may the use of unsuitable tools for the silencer elements.

According to another preferred version of the invention, all thread connections, but at least those among the chamber parts themselves, are fixed after assembly in an essentially inseparable fashion, for example, by over-crimping or centering the circumferential joints. In this way the chamber parts and possibly also the other elements of the silencer can be made of a relatively soft, easily machined material, which essentially would not withstand repeated unscrewing and screwing without damage to the threads. If needed, cleaning can be accomplished by flushing.

The chamber parts preferably consist of an easily machined aluminum alloy, as does the end piece. The attachment piece, which is subject to frequent screwing onto the barrel muzzle of the firearm onto which the silencer is to be placed and which must then again be unscrewed from it, may consist of a material that can be subjected to greater stress.

According to another embodiment of the invention, the outer wall of each chamber part essentially consists of a longitudinal jacket, whose end segments hold the mutually complementary circumferential threads. Preferably, the longitudinal jackets are constructed as circular cylindrical jackets. Such a construction of the chamber parts enables a particularly simple assembly of the silencer. The successive outer walls of the longitudinal jackets together form the outer wall of the silencer.

A crossbar positioned inside each of the chamber parts that tapers outward towards the front in the manner of a funnel promotes the silencing action in the known manner.

The crossbar can be positioned at that end of the chamber part or the longitudinal jacket that carries the male thread.

According to a preferred version of the invention, the crossbar, however, is positioned in a middle sector of the outer wall of the chamber part, i.e., of the longitudinal jacket, which means in an area not taken up by the threads. When assembling the silencer, a clamping tool may be used on this area; the crossbar then supports the tool's engagement.

This again permits a thin-walled construction of the outer chamber wall, i.e., of the longitudinal jacket, without having to worry about problems during assembly. The same advantage is achieved when the chamber pan is clamped in the chuck of an automatic lathe during its manufacture. The crossbar is preferably connected integrally to the longitudinal jacket.

As is known, the firing opening in each crossbar should be as small as possible so that, after the projectile has passed through, the narrowest possible choke point is formed for the powder gases that follow. Although a direct brushing of the projectile against the wall is prevented by dimensioning the firing opening properly, erosion at this point will be very high. This is why the firing opening can become wider after protracted use of the silencer, thus reducing the silencing effect.

To remedy this problem, another version of the invention provides that the firing opening is lined with a bushing that may consist of a material more resistant than that of the chamber part, such as steel.

The effectiveness of the silencer according to the invention is further enhanced in that the end piece and/or the attachment piece are provided with an additional pressure relief chamber, especially since they already have the corresponding length, if they are provided with a male or female thread. The pressure-relief chamber formed in the end piece is preferably constructed as a diaphragm body that suppresses the muzzle flash.

As noted earlier, chamber parts with different dimensions and shapes can be assembled so as to form a silencer according to the invention; preferably, however, the chamber parts of the silencer have the same structural design. That prevents any mix-up during assembly and, at the same time, achieves a particularly simple manufacturing process.

BRIEF DESCRIPTION OF THE DRAWING

The invention will be explained in greater detail with the help of the enclosed diagram. The only FIGURE here illustrates, virtually to scale, a longitudinal section through a currently preferred embodiment of a silencer according to the invention.

DESCRIPTION OF THE PREFERRED EMBODIMENT

The silencer shown is intended for the model G3 rifle made by the applicant. It has a total length of 255 mm; its maximum outside diameter is 40 mm and it protrudes 152 mm beyond the muzzle of the G3 rifle.

According to the FIGURE, the silencer consists of three main parts, i.e., an attachment piece 2, a middle part 4, and an end piece 6.

Attachment piece 2 consists of a longish tube widened like a cup in front and preferably consisting of aluminum; from back to front, it comprises the following in succession: a tube segment 8, a narrowed cylindrical adapter segment 10, a threaded segment with an internal threading 12, a stop shoulder 14 that extends radially inward, a passage 16 whose diameter exceeds the diameter of a projectile fired from the rifle (not shown) only by a small amount, a chamber 18 tapering conically outward towards the front, and an extensively widened cup segment 20 with a fine female thread 22.

After the muzzle flash suppressor has been unscrewed from the muzzle of a G3 rifle, attachment piece 2 is screwed onto the barrel muzzle with its internal threading 12. In the process, adapter segment 10 is pushed tightly onto a complementary adapter segment of the barrel muzzle, and the front of the barrel muzzle rests against stop shoulder 14. Stop shoulder 14, internal threading 12 and adapter segment 10, internal threading 12, and adapter segment 10 thus center attachment piece 2 exactly on the barrel muzzle.

Middle part 4 is made up of several chamber parts 24, in this case four such parts that are screwed together. One of these chamber parts 24 will be described below.

Each chamber part 24 consists of a high temperature aluminum alloy and has an overall circular-cylindrical, tube-shaped longitudinal jacket 26 with an overall smooth, circular-cylindrical inside wall and outside wall 28. The front end of longitudinal jacket 26 is bored and is provided with a free female thread 30 that in terms of length and other dimensions is identical to the female thread 22 in cup segment 20 of attachment piece 2.

The rear end of longitudinal jacket 26 has a fine male thread 32 that in terms of length and dimension complements the fine female threads 22 and 30.

A crossbar 34 fills up the clear width of longitudinal jacket 26. It has the shape of a funnel that is concentric to longitudinal jacket 26 and becomes wider towards the front; its edge in the area between the two fine thread ends 30 and 32 is connected integrally with the inside wall of longitudinal jacket 26.

The front-facing inside wall of the funnel-shaped crossbar 34 does not form any continuous, truncated cone-shaped surface; instead it consists of a radially internal rear truncated-cone surface and a radially external front truncated-cone surface separated from the former. The internal truncated-cone surface has a smaller apex angle and blends into the external truncated-cone surface. This design of chamber part 24 enhances the silencing effect.

The narrow point of funnel 34, thus fashioned, lies roughly in a radial plane with the rear end of longitudinal jacket 26. A tightly fitting bushing 36 of steel plate is pressed into it and is bent to the rear and radially outward around the rear end of the narrow point. Steel bushing 36 is thus inseparably and firmly connected with the funnel's narrow point and lines it. In consideration of all of the occurring tolerances, the inside clearance of steel bushing 36 is dimensioned so that the projectile can just pass through without brushing against it.

In the FIGURE, four such chamber parts 24 are screwed together. The space of the back chamber part 24 located in front of crossbar 34 and the space of the front chamber part 24 located behind crossbar 34 together form an expansion chamber whose outer wall is made up of the successive outer walls 28 of the two adjoining longitudinal jackets 26.

The muzzle of chamber 18 of attachment piece 2, which becomes wider towards the front, is positioned and dimensioned so that a relatively narrow ring-shaped gap is created towards the rear outer circumferential edge of steel bushing 36 or of crossbar 34 of the rear-most chamber part 22. The ring-shaped gap leads into a first expansion chamber that is limited by the following pans: the rear of crossbar 34 and the rear part of longitudinal jacket 26 of the rear-most chamber part 24, as well as the bottom of the cup-like extension 20 of attachment piece 2.

End piece 6 is an essentially bowl-shaped body with a short tube socket 38, one of whose ends is closed off by an outwardly arched end wall 40. An exit opening 42 is located in the center of the end wall 40. The inside edge of exit opening 42 is countersunk to a large degree.

The outside of tube socket 38 carries a male thread 44 whose dimensions match the male threads 32 of chamber parts 24.

The inside of tube socket 38 has an internal threading 46, into which is screwed a diaphragm body 48 that acts as a muzzle flash or flame suppressor. For this purpose, diaphragm body 48 has a threaded ring 50 whose rear end is closed off with a radial plate 52. An exit bore-hole extends through the center of radial plate 52. The circumferential edge of said bore-hole extends all the way to the inside surface of the adjoining longitudinal jacket. Diaphragm body 48 can be made of an easily machined aluminum alloy, but it can preferably be made of a more resistant material. The exit bore-hole can be lined with a steel plate bushing, similar to bushings 36.

Diaphragm body 48 and end wall 40 of end piece 6 define a last expansion chamber 49 that is located at the very front.

Two pocket bore-holes 54 are provided—on both sides of the exit opening 42—in the forward-facing outside surface of end wall 40; a wrench for turning end piece 6 and thus for tightening all threads 16, 30, 34, 44, and 46, can engage said pocket bore-holes, whereby the rear, tube-like end of attachment piece 2, for example, can be held firmly in a spring chuck.

Threads 16, 30, 32, 44, and 46 are preferably filled with a heat-resistant putty or adhesive, prior to screwing, or they are mortised or otherwise secured after tightening, so that the ready-assembled silencer can no longer be taken apart.

I claim:

1. A silencer for a firearm, said silencer having a composite outer wall, said silencer comprising:

(a) an end piece that forms a silencer muzzle and in which is located an exit opening;

(b) an attachment piece for releasably attaching said silencer to said firearm;

(c) a middle piece that is positioned between said attachment piece and said end piece, said middle piece comprising a selected, variable number of successive chamber parts being aligned with each other, each of said selected number of chamber parts having a firing opening and an outside wall, each of said selected number of chamber parts is attached in a modular fashion directly to an adjoining one of said selected number of chamber parts and includes a front and a back portion;

(d) said outside walls of said selected, variable number of chamber parts forming said composite silencer outer wall;

(e) said selected, variable number of said chamber parts being selected in accordance with the intended use of said silencer; and (f) means associated with each pair of adjacent chamber parts of said middle piece for directly attaching together said adjacent chamber parts of said pair of said adjacent chamber parts, said attaching means comprises mutually complementary circumferential threadings constructed on said front and back portions respectively.

2. A silencer as defined in claim 1, wherein each of said selected number of chamber parts is attached to each other in a gas-tight manner.

3. A silencer as defined in claim 1, wherein each of said selected number of chamber parts is characterized in that all chamber parts are constructed identically.

4. A silencer as defined in claim 1, wherein said circumferential threadings are inseparably fixed after said chamber parts have been attached to each other.

5. A silencer as defined in claim 1, wherein said outside wall of each of said selected number of chamber parts consists essentially of a longitudinal jacket having free end segments, in which said circumferential threadings are respectively mounted.

6. A silencer as defined in claim 1, wherein said firing opening is lined with a bushing.

7. A silencer as defined in claim 1, wherein one of said attachment piece and said end piece is provided with a pressure-relief chamber.

8. A silencer as defined in claim 1, wherein said end piece includes a diaphragm body for suppressing muzzle flash.

9. A silencer for a firearm, said silencer having a composite outer wall, said silencer comprising:

(a) an end piece that forms a silencer muzzle and in which is located an exit opening;

(b) an attachment piece for releasably attaching said silencer to said firearm; and (c) a middle piece that is positioned between said attachment piece and said end piece, said middle piece comprising a selected, variable number of successive chamber parts being aligned with each other, each of said selected number of chamber parts having a firing opening and an outside wall, each of said selected number of chamber parts is attached in a modular fashion directly to an adjoining one of said selected number of chamber parts;

(d) said outside walls of said selected, variable number of chamber parts forming said composite silencer wall;

(e) said selected, variable number of said chamber parts being selected in accordance with the intended use of said silencer;

f) each of said selected number of chamber parts includes a rear-most chamber and a foremost chamber, one of said rear-most and foremost chamber parts is attached directly to a front portion of said attachment piece by a first threading, and another of said rear-most and foremost chambers is attached directly to a back portion of said end piece by a second threading.

10. A silencer for a firearm, said silencer having a composite outer wall, said silencer comprising:

(a) an end piece that forms a silencer muzzle and in which is located an exit opening;

(b) an attachment piece for releasably attaching said silencer to said firearm; and (c) a middle piece that is positioned between said attachment piece and said end piece, said middle piece comprising a selected, variable number of successive chamber parts being aligned with each other, each of said selected number of chamber parts having a firing opening and an outside wall, each of said selected number of chamber parts is attached in a modular fashion directly to an adjoining one of said selected number of chamber parts;

(d) said outside walls of said selected, variable number of chamber parts forming said composite silencer wall;

(e) said selected, variable number of said chamber parts being selected in accordance with the intended use of said silencer;

(f) each of said selected number of chamber parts includes a front and a back portion, and mutually complementary circumferential threadings constructed on said front and back portions respectively;

(g) said outside wall of each of said selected number of chamber parts consists essentially of a longitudinal jacket having free end segments, in which said circumferential threadings are respectively mounted;

(h) each of said selected number of chamber parts includes internally thereof a crossbar, said firing opening is located in said crossbar, said crossbar includes said front portion, said crossbar being configured as a funnel with its diameter increasing towards said front portion.

11. A silencer as defined in claim 10, wherein said longitudinal jacket includes a middle portion and said crossbar is connected with said middle portion in an integral fashion.

* * * * *